US005941605A

United States Patent [19]

Miraglia et al.

[11] Patent Number: 5,941,605

[45] Date of Patent: Aug. 24, 1999

[54] LASER CUTTING OF BRUSHES

[75] Inventors: Loretta A. Miraglia, Monsey; Jack Lombardi, Massapequa, both of N.Y.

[73] Assignee: Color Access, Inc., Melville, N.Y.

[21] Appl. No.: 08/992,656

[22] Filed: Dec. 17, 1997

[51] Int. Cl.[6] ..... A46D 9/02

[52] U.S. Cl. ..... 300/21

[58] Field of Search ..... 300/17, 21

[56] References Cited

U.S. PATENT DOCUMENTS

| | | | |
|---|---|---|---|
| 4,233,260 | 11/1980 | D'Argembeau | 300/21 X |
| 5,007,686 | 4/1991 | Klein et al. | 300/21 |
| 5,020,551 | 6/1991 | Guerret | 132/200 |
| 5,197,497 | 3/1993 | Gueret | 132/218 |
| 5,345,644 | 9/1994 | Gueret | 15/160 |
| 5,588,714 | 12/1996 | Boucherie | 300/21 |

FOREIGN PATENT DOCUMENTS

| | | | |
|---|---|---|---|
| 223239 | 5/1987 | European Pat. Off. | 300/21 |

*Primary Examiner*—Mark Spisich
*Attorney, Agent, or Firm*—Kenyon & Kenyon

[57] ABSTRACT

This invention provides a method for cutting the bristles of a cosmetic brush by means of a laser beam, which comprises directing a focused laser beam on a bristle, the beam remaining focused on the bristle for a time sufficient to cut through the bristle. The increased accuracy of the laser beam as a cutting tool provides for brush designs which are unable to be achieved by conventional cutting methods.

9 Claims, 1 Drawing Sheet

LASER CUTTING OF BRUSHES

FIELD OF THE INVENTION

This invention relates to a method of shaping the bristles of a cosmetic brush. More particularly, it relates to a method of cutting the edges of bristles of a cosmetic brush in order to obtain a desired shape.

BACKGROUND OF THE INVENTION

Cosmetic brushes, depending on their intended use, require different shapes and styles in order to provide optimum application of product. To obtain the desired shape, most brushes are assembled first, and then the bristles are shaped. The shaping of the bristles is accomplished by a number of methods.

One method of shaping a brush is an actual mechanical cutting of the edges of the bristles with a knife or clippers. Most brushes are shaped in this manner. For example, when the bristles of a blush brush are assembled into a handle, the edges of the bristles are then trimmed by clippers into the desired shape. This is a time consuming process because the blades of the clippers need to be kept constantly sharp to provide a "clean" cut. Each time the blade wears down, the shaping process must be stopped so that the blades can be changed. This constant changing of parts has a definite negative impact on the number of units that can be produced, the ongoing quality, accuracy, and repeatability of those units, and the overall cost.

U.S. Pat. No. 5,020,551 discloses a method of manufacturing a mascara brush wherein the edges of the bristles are shaped by grinding. There are numerous drawbacks with the use of this method of shaping the edges of the bristles. The major disadvantage to using this method is the lack of accuracy with which the bristles can be shaped. In order to effectively shape the bristles using this method, the bristles have to be a certain stiffness and structure, thus, the bristles used cannot be soft. Second, the bristle brush surface cannot be intricately cut along its length with a grinding wheel. The shaping of a brush using a grinding wheel limits the cutting to broad surface cuts, generally 3 to 4 turns of the wire core. Additionally, the use of a grinding wheel, if not controlled precisely, will cause a build up of excessive heat which will cause the bristles to melt or deform, thus making the brush useless. Also, using a grinding wheel to shape the brush will not ensure the same shape for each brush produced. As the grinding wheel wears down, each brush will vary slightly from the previous one, thereby making the last brush produced significantly different from the first brush produced from the same grinding wheel. Additionally, the process of grinding the bristles to form a particular brush shape is a slow process.

Another method of shaping the edges of a brush, as disclosed in U.S. Pat. No. 5,197,497 and U.S. Pat. No. 5,345,644, is via a radiant heat source. This method is mainly used with synthetic fibers, such as plastics. With this method, a heat source is provided which is directed at the edges of the bristles. When the bristles reach their melting point the ends begin to curl over. This causes the length of the bristle to shorten and also creates a burr at the tip of the bristle. This burr negatively affects application of the product because, while combing the lashes, the burr will pull at the lashes thereby making application uncomfortable to the consumer. Depending on the temperature and duration of the heat source in a particular location, different shapes can be obtained. This method of manufacture is not always desirable because it does not allow for a great degree of control over the length of the bristles. Slight imperfections in the bristles themselves will cause the bristles to deform and melt at different rates, thereby causing each bristle to be a different length. Also, when bristles are shaped in this manner they very often fuse together during the melting process.

In contrast to previous methods, the present invention provides a precise, accurate, reliable, and consistent method of manufacturing a brush.

The present invention also provides a method of manufacturing a brush which allows a greater degree of flexibility in the design chosen for the bristles.

Further, this invention provides a method of manufacturing a brush which can be adapted for use with any cosmetic brush.

Also, this invention provides a method of manufacturing a brush which is economically advantageous.

SUMMARY OF THE INVENTION

This invention provides a method for cutting the bristles of a cosmetic brush by means of a laser beam, which comprises directing a focused laser beam on a bristle, the beam remaining focused on the bristle for a time sufficient to cut through the bristle.

According to the invention there is provided a brush for applying a makeup product, comprising a multiplicity of bristles attached to a handle. A laser is then provided which cuts through the bristles. The increased accuracy of the laser beam as a cutting tool provides for brush designs which are unable to be achieved by conventional cutting methods.

DETAILED DESCRIPTION OF THE INVENTION

Figure 1:
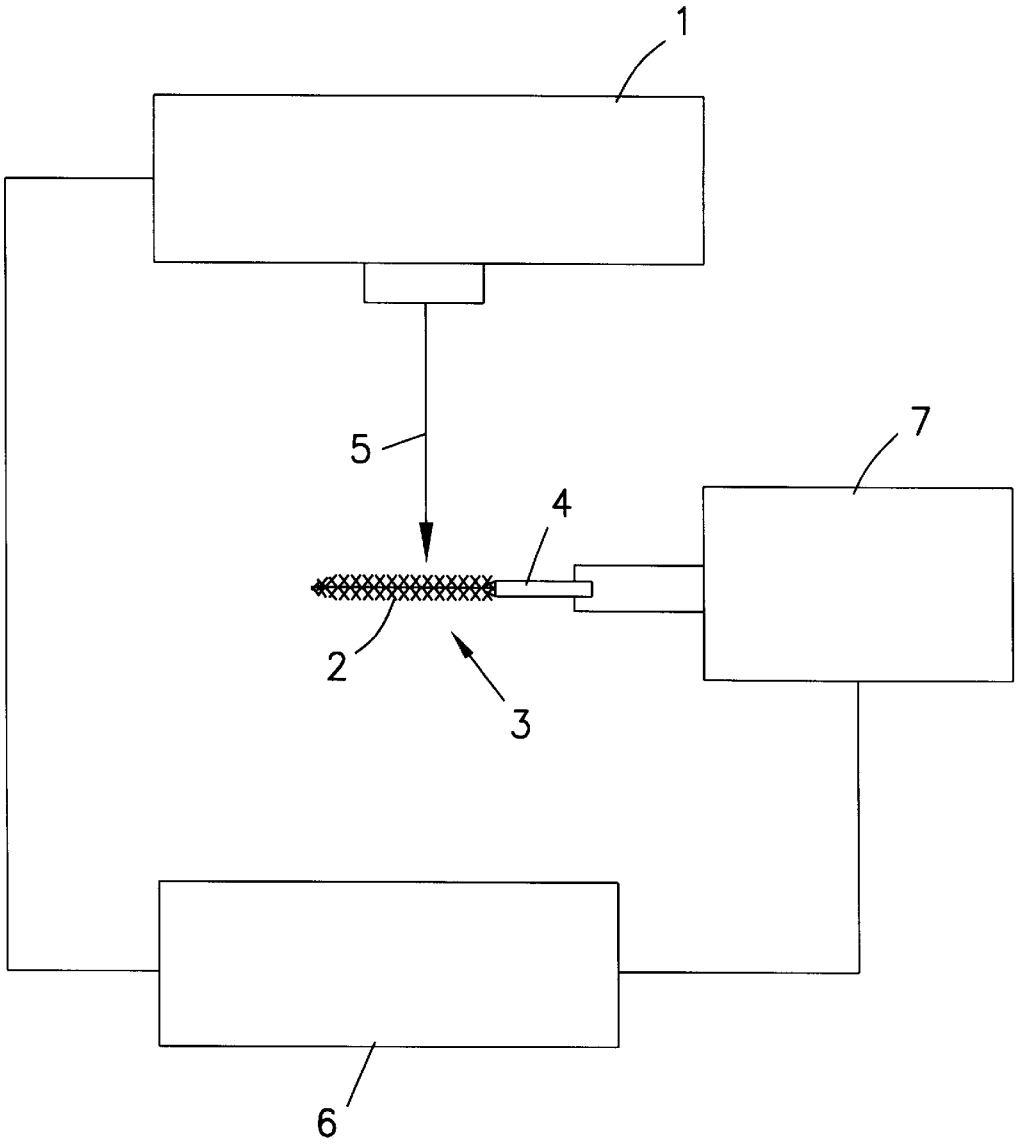
FIG. 1 is a schematic representation of a brush shaping machine which is used to carry out the method according to the invention.

A system has been devised where high processing speeds and precision are combined to cut and/or shape a cosmetic brush. As shown in FIG. 1, this system utilizes a laser 1 to cut the bristles 2 of a cosmetic brush, generally referred to as 3. The use of a laser within the system allows for the continuous cutting of the bristles without the need for direct contact of cutting blades against the bristles, or the new tooling of a die for each new brush design. This non-contact method of trimming is superior because it provides for a clean cut. Also, when intricate and delicate cuts are needed, traditional tools are not accurate enough to provide the desired reliability, and the use of a laser is an appropriate alternative.

First, a brush 3 for applying a make-up product is provided, using methodology standard in the art. The brush 3 comprises a multiplicity of bristles 2 mounted on a handle 4. After mounting of the bristles on the handle, the brush can then be shaped into the desired configuration. The bristle itself can be composed of synthetic or natural materials, such as plastics or animal hair. Preferable synthetic materials include nylon, polyester, cellulose acetate, and the like; and preferable natural materials include goat hair, pony hair, and other like materials. Most preferably, the bristles are PET (polyethylene terephthalate).

The bristles used for the brush preferably have a diameter which ranges from 0.001 to 0.020 inches. Most preferably, the bristles have a diameter which ranges from 0.002 to 0.006 inches. The bristle, however, is not limited to any specific profile or cross-section. For example, a round hollow bristle could be used, as well as a star-shaped solid bristle, or a flat solid bristle. The choice of bristle profile and cross-section will be based on the specific function for which the bristle is intended to be used, and is not limited in any way by the cutting mechanism.

Generally speaking, any type of laser can be used to cut bristles. However, for any given specific task, the choice of laser to be used will be made based primarily on the identity of the material to be cut, and also on the level of precision required for the particular cutting to be accomplished. Any type of fiber to be used for the bristles of the brush will have a defined melting point. It is important, in the cutting process, to avoid temperatures which will be so high as to melt the bristle being cut, as this will lead to fusing of the bristles, or the ends of the bristles curling over on themselves. Just as different fibers have different melting points, various kinds of lasers have different wattages, and therefore generate different levels of heat during the cutting process. As a general rule, low to medium wattage lasers, i.e., those with a wattage of less than 100, for example, solid state lasers, carbon dioxide lasers, helium lasers, or neon lasers, generate heat less quickly, and cut more slowly, but with a very high level of precision, for example, down to 0.0001 inches. In contrast, higher wattage lasers, i.e., those with a wattage of 100 or more, generate heat much more quickly, completing the cutting more quickly, but generally with a lower level of precision than a lower wattage laser. Thus, given a particular fiber of choice, and the foregoing guidelines, the skilled individual can readily select the proper laser for the purpose, by balancing the factors of laser wattage, exposure time, properties of the material being cut, and level of precision required for the specific cut to be made.

As a specific example, a common choice of fiber for a mascara brush is PET. The melting point of PET is approximately 490° F. Carbon dioxide lasers come in a variety of wattages. A $CO_2$ laser having a wattage of 60 W or more is appropriate for cutting materials with melting points of 500° F. or greater, but would not be appropriate for PET. A lower wattage radio frequency $CO_2$ laser, for example, one with a wattage of 50 or less, will generate a lower level of heat (e.g., 480° F. or less) which can readily be used for cutting PET fiber. Generally, fibers for a cosmetic brush range from 0.001 to 0.02 inches in diameter, and with the precision of the laser cutting process, it is possible to cut one fiber at a time. Thus, the laser cutting process provides for a higher degree of precision in the shaping of a cosmetic brush.

A radio frequency, sealed carbon dioxide laser, or a gas assisted carbon dioxide laser, is preferred. Depending on the particular cutting to be performed, the beam 5 emitted from the chosen laser can be a continuous beam, or a pulse type beam. Such lasers are widely commercially available from, for example, The Industrial Laser Source, Inc., 1C Spaceway Lane, Hopedale, Mass. 01747. For the aforementioned lasers, a power range of 5 to 200 watts is preferred, while 25 to 100 watts is most preferred.

Additionally, other cutting aids can be used in the aforementioned process. These cutting aids include such things as a cool air chamber or a vacuum chamber, which is provided to dissipate the heat produced and remove the trimmings from the edge of the bristle after cutting with the laser beam. Also, an exhaust system can be added to filter the fumes that are a by product of the cutting process.

Also, cutting of the bristles can be done by making use of the reflective properties of the bristles to cut specific fibers. If certain bristles are desired to be cut, they may be colored so as to allow the chosen laser to cut only those fibers which will absorb the particular wavelength of light emitted by the chosen laser. For example, a laser which emits a blue beam can be used to cut black fibers in blue fiber matrix. The blue colored fibers will not be cut by the blue laser because blue fibers reflect the wavelength of blue light, and a laser cannot cut a material which will not absorb the wavelength of light emitted by that laser. Therefore, a selective cutting pattern can be established by varying bristle colors.

To obtain the desired shape of the brush 3, the laser bursts 5 are spot focused onto each individual bristle 2 via a pre-selected pattern, cutting the bristle with zero force. The spot focusing of the laser bursts 5 is controlled via a computer program 6, such as AutoCAD, CAD/CAM, or any other appropriate computed aided design program, and automated workpiece handling equipment 7. Both of these items are preferably integrated with the laser.

To run the system, the desired pattern for the brush shape is input into the computer 6. After the shape is input, the laser 1 is activated and the automated workpiece handling equipment 7 moves either the brush 3, or the laser 1, in a way which causes the bristles 2 to be cut by the laser 1 in the shape of the computer image.

The pattern selected will depend on the type of cosmetic brush being shaped, but the method can be applied to any brush in which cutting of bristles to achieve a particular shape or pattern is desired. Because of this advancement, shapes can be obtained which were heretofore unachievable, or cost prohibitive. Depending on the area of use of the cosmetic brush to be shaped, one of ordinary skill in the art can readily select a brush shape which is the most effective for delivery of the make-up product.

Additionally, the laser beam can be split to provide for multiple part processing, or for multiple location cutting of single brush. For example, after the laser beam is generated, the beam can be optically split into one or more beams, which in turn can each be used to shape a brush. This process can be incorporated to increase the number of brushes which can be shaped within a given time period without the need of an additional laser.

The availability of a laser brush cutting system makes it possible to personally customize a particular type of brush, such as a mascara brush, to each individual consumer's need. For example, in order to obtain the designs needed for the shaping of a variety of brushes, an unlimited number of different brush designs, each adapted for a specific type of application, are input into a database. Then, the consumer, or beauty consultant, can identify the particular features of the consumer in the area in which the cosmetic is to be applied. This information can then be entered into the database, which will then match a brush shape for the application needed to match that particular consumer's features. After that, the above-described laser system can be used to provide a specific brush for that specific consumer's features. For example, a database containing a variety of mascara brush designs, each adapted to a specific type of lash profile, e.g., long, short, thick, sparse, etc., is provided. Next, a consumer, or a beauty consultant, identifies the consumer's lash type. That particular lash type is input into the database, which then matches a particular brush shape which suits that consumer. That brush shape is then easily generated by the laser system, and a personally customized brush is provided to the consumer.

The invention, and its broader aspects, is not limited to the specific details shown and described; rather, various modifications will be suggested to one skilled in the art, all of which are within the scope and spirit of this invention.

What is claimed is:

1. A method for shaping the bristles of a mascara brush, which comprises:

directing a focused laser beam on a bristle, the beam having a cutting temperature and remaining focused on the bristle for a time sufficient to cut through the bristle without fusing the bristle to another or melting the bristle; and advancing the laser beam to one or more additional bristles until a pre-selected shape is obtained, said pre-selected shape being effective for the application of a mascara product to eyelashes.

2. The method of claim 1 wherein a computer aided design system, and an automated workpiece handling system are integrated with the laser.

3. The method of claim 2 wherein the computer aided design system is provided with a database containing a variety of mascara brush shapes.

4. The method of claim 1 wherein the laser beam is emitted from a carbon dioxide laser.

5. The method of claim 4 wherein the laser has a power range from about 5 to about 100 watts.

6. The method of claim 5 wherein the laser has a power range from about 25 to about 100 watts.

7. The method of claim 1 wherein the bristles are composed of synthetic or natural fibers.

8. The method of claim 1 wherein the bristle has a melting point higher than that of the laser beam at the focal point.

9. A method of providing a consumer with a customized mascara brush, comprising:

(a) providing a database containing a variety of brush designs, each design adapted to a specific consumer eyelash type;

(b) evaluating the consumer's eyelashes to identify the consumer's lash type;

(c) matching the lash type to a brush design in the database; and (d) using the design to generate a laser-cut brush matched to the consumer's lash type.

* * * * *